US008523252B2

(12) United States Patent
Upshaw

(10) Patent No.: US 8,523,252 B2
(45) Date of Patent: Sep. 3, 2013

(54) LIFT DEVICE FOR SERVICE OPERATIONS ON MECHANICAL PARTS

(75) Inventor: Christopher M. Upshaw, Murfreesboro, TN (US)

(73) Assignee: Spectra Energy Corp, Houston, TX (US)

( * ) Notice: Subject to any disclaimer, the term of this patent is extended or adjusted under 35 U.S.C. 154(b) by 37 days.

(21) Appl. No.: 13/427,673

(22) Filed: Mar. 22, 2012

(65) Prior Publication Data

US 2012/0242100 A1 Sep. 27, 2012

Related U.S. Application Data

(60) Provisional application No. 61/466,626, filed on Mar. 23, 2011.

(51) Int. Cl.
*B66C 1/42* (2006.01)

(52) U.S. Cl.
USPC ..... 294/67.31; 294/67.5; 294/86.41; 414/758

(58) Field of Classification Search
USPC ..... 294/67.1, 67.3, 67.31, 67.33, 67.4, 294/67.41, 67.5, 68.26, 68.27, 68.3, 86.41; 414/758, 759, 783
See application file for complete search history.

(56) References Cited

U.S. PATENT DOCUMENTS

| | | | | | |
|---|---|---|---|---|---|
| 1,390,212 | A | * | 9/1921 | Murray | 294/68.26 |
| 1,486,609 | A | * | 3/1924 | Schwab | 414/758 |
| 1,614,400 | A | * | 1/1927 | Selman et al. | 294/68.26 |
| 3,608,757 | A | * | 9/1971 | Tary | 414/414 |
| 4,451,198 | A | * | 5/1984 | Sanderson | 414/779 |
| 5,221,118 | A | * | 6/1993 | Koltookian | 294/86.41 |
| 5,411,306 | A | * | 5/1995 | Campbell et al. | 294/81.4 |
| 5,429,490 | A | * | 7/1995 | Myers et al. | 425/436 R |

* cited by examiner

*Primary Examiner* — Dean Kramer
(74) *Attorney, Agent, or Firm* — Jackson Walker L.L.P.

(57) ABSTRACT

A disclosed lift device serves as a work piece handling tool for performing service operations on a mechanical component, such as a power cylinder head of a gas engine compressor. The lift device may be attached to the cylinder head and used to securely and efficiently remove (and install) the cylinder head from the gas engine compressor. The lift device may also provide a free-standing base for holding the cylinder head securely in a manner that provides access for servicing operations. The advantages of the lift device include a single mounting and unmounting operation for the entire duration of the servicing operations.

22 Claims, 3 Drawing Sheets

LIFT DEVICE FOR SERVICE OPERATIONS ON MECHANICAL PARTS

CROSS REFERENCE TO RELATED APPLICATIONS

This application claims priority from U.S. Provisional Patent Application No. 61/466,626, filed on Mar. 23, 2011, entitled "LIFT DEVICE FOR SERVICE OPERATIONS ON MECHANICAL PARTS", which is incorporated by reference herein.

BACKGROUND

1. Field of the Disclosure

The present disclosure relates to a lift device and, more particularly, to a lift device for servicing mechanical parts.

2. Description of the Related Art

Maintenance and/or repair of industrial machinery may involve delicate handling of massive mechanical parts. For example, service operations on power cylinders of a gas engine compressor may often involve removal of a power cylinder head. The power cylinder head is often a heavy work piece that may be damaged by removal, positioning, and handling during routine service operations.

DESCRIPTION OF EXEMPLARY EMBODIMENTS

In the following description, details are set forth by way of example to facilitate discussion of the disclosed subject matter. It should be apparent to a person of ordinary skill in the field, however, that the disclosed embodiments are exemplary and not exhaustive of all possible embodiments.

Disclosed herein is a lift device usable as a tool for handling a head of a power cylinder of a large engine, such as a gas engine compressor. The head of the power cylinder head is referred to herein as the "cylinder head" or the "work piece", while the power cylinder is referred to herein as the "cylinder". Although the present disclosure is described with respect to a gas engine compressor, the lift device described herein may be used in conjunction with a number of different mechanical parts of various types of large engines. One example of a type of mechanical part that an embodiment of the disclosed lift device is suitable for handling is a power cylinder head of an Cooper-Bessemer type GMV gas engine compressor.

Figure 1:
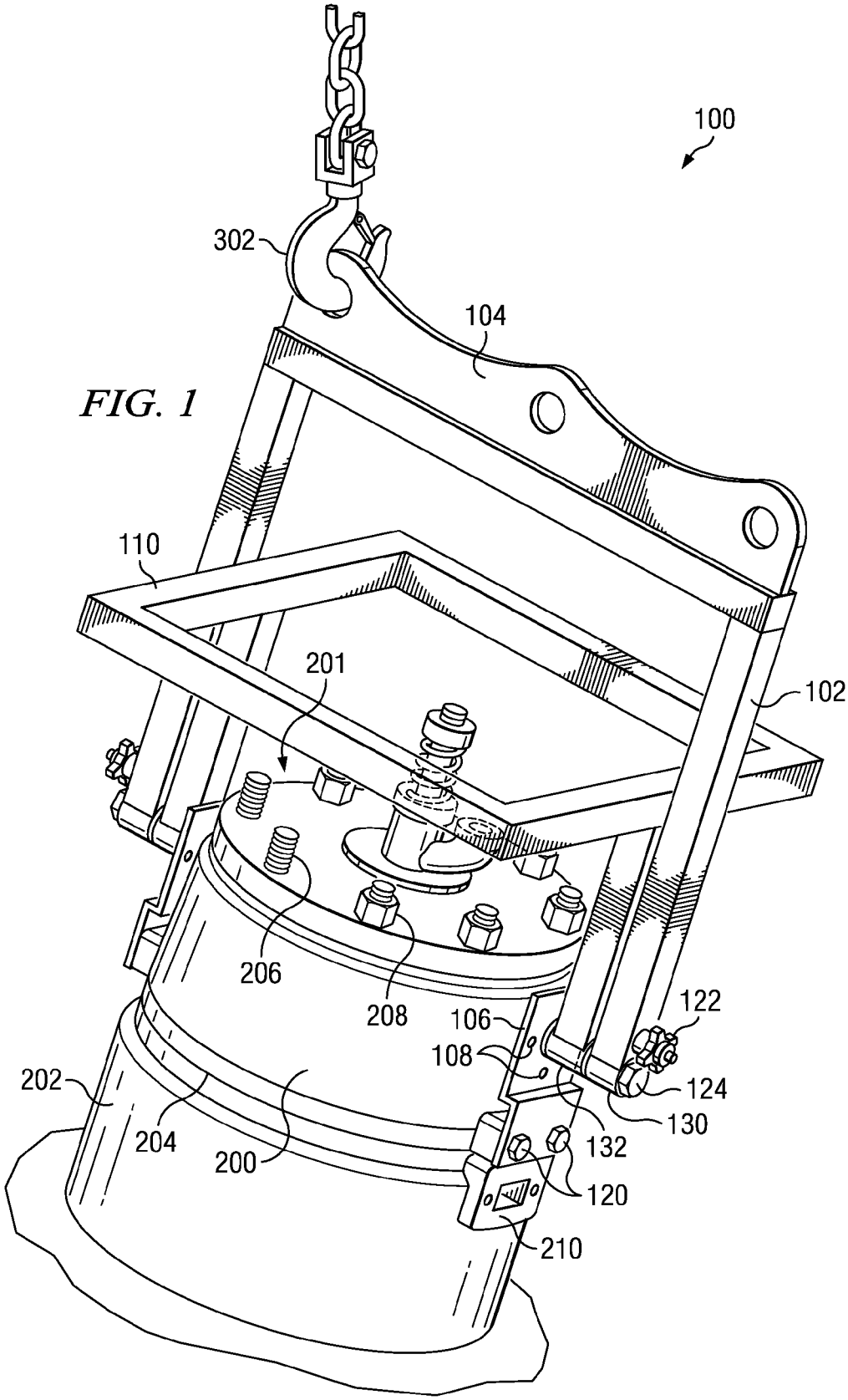
FIG. 1 is an image showing selected elements of an embodiment of a lift device.

Turning now to the drawings, FIG. 1 depicts an image showing selected elements of an embodiment of novel lift device 100. In FIG. 1, lift device 100 is shown in preparation for removal of cylinder head 200 from cylinder 202. Cylinder 202 is intended to be representative for various implementations of power cylinders on different types of large engines and/or gas engine compressors. It is noted that a gas engine compressor with which lift device 100 is used may be equipped with multiple instances of cylinder 202. Thus, service operations described herein for a single power cylinder may involve multiple repetitions when working on a gas engine compressor. Cylinder 202 may be joined to cylinder head 200 at seal surface 204, which is visible in FIG. 2 as a circular crack. Pressure may be applied to seal cylinder 202 with cylinder head 200 using studs 206 and mounting nuts 208, which may be fastened at top portion 201 of cylinder head 200.

As shown in FIG. 1, lift device 100 may be comprised of lift frame 102 and stand 110. Lift frame 102 may comprise three members in a rectangular U-configuration to receive stand 110. Different embodiments (not shown) of lift frame 102 may incorporate other geometries, such as circular, triangular, and/or based on other polygons. At the top of lift frame 102, flange 104 may provide one or more attachment holes for lift hook 302 in various configurations. In one embodiment, a precise location of an attachment hole may cause lift device 100 to tilt, when lifted by the attachment hole, at a first angle roughly corresponding to a second angle given by an operational orientation of the work piece. The second angle may represent, for example, an orientation of cylinder 202 with respect to the engine in which cylinder 202 operates. In this manner, lift device 100 may provide for safer and expedited attachment of the work piece. Stand 110 may be coupled to lift frame 102 via pivot pin 124, which may define an axis of rotation around which stand 110 may rotate fully (i.e., 360 degrees) with respect to lift frame 102. Pivot pin 124 may penetrate a first bushing (obscured from view) contained within cylindrical end 130 of lift frame 102 and a second bushing (obscured from view) within cylindrical end 132 of stand 110, along with head connector 106. In certain embodiments, cylindrical ends 130, 132 are themselves bushings. Pivot pin 124 may be fixed with a pivot nut (obstructed from view in FIG. 1) behind head connector 106. Head connector 106 may be in the form of a plate having various holes, including holes for receiving pivot pin 124 and mounting bolts 120, as will be described in further detail below.

Head connector 106 may further include locking holes 108 for receiving locking pin 122, which may be used to mechanically secure stand 110 with respect to lift frame 102 by arresting rotation of stand 110 around pivot pin 124. Locking pin 122 may be equipped with internal spring-loaded ball bearings (not visible in FIG. 1) to facilitate entry and removal from locking holes 108. Different instances of locking hole 108 may provide detention of stand 110 (and a work piece attached thereto) at desired angular positions in conjunction with locking pin 122 (see also FIG. 3).

In FIG. 1, on each side of cylinder 202 and cylinder head 200 is water jumper 210 (of which only one instance is visible as shown) that forms a mounting surface. Water jumper 210 may include an opening to receive cooling water as well as threaded mounting holes, which may be used by lift device 100 to attach head connector 106 to cylinder head 200 using mounting bolts 120.

In operation, lift device 100 may be positioned above cylinder head 200 using lift hook 302. Lift device 100 may then be attached to cylinder head 200 at head connector 106 using mounting bolts 120. Lift device 100, as shown, may provide access to top portion 201 of cylinder head 200 for work piece removal operations, such as removal of mounting nuts 208. Rotation of stand 110 may be arrested by inserting locking pin 122 into an appropriate one of locking holes 108. After cylinder head 200 has been mechanically separated from cylinder 202, lift device 100 may allow lift hook 302 to securely lift and transport cylinder head 200 to a desired location for service operations, as will be described below with respect to FIGS. 2 and 3. It is noted that the operations described above may be performed in a reverse order using lift device 100 when cylinder head 200 is mounted to cylinder 202.

Figure 2:
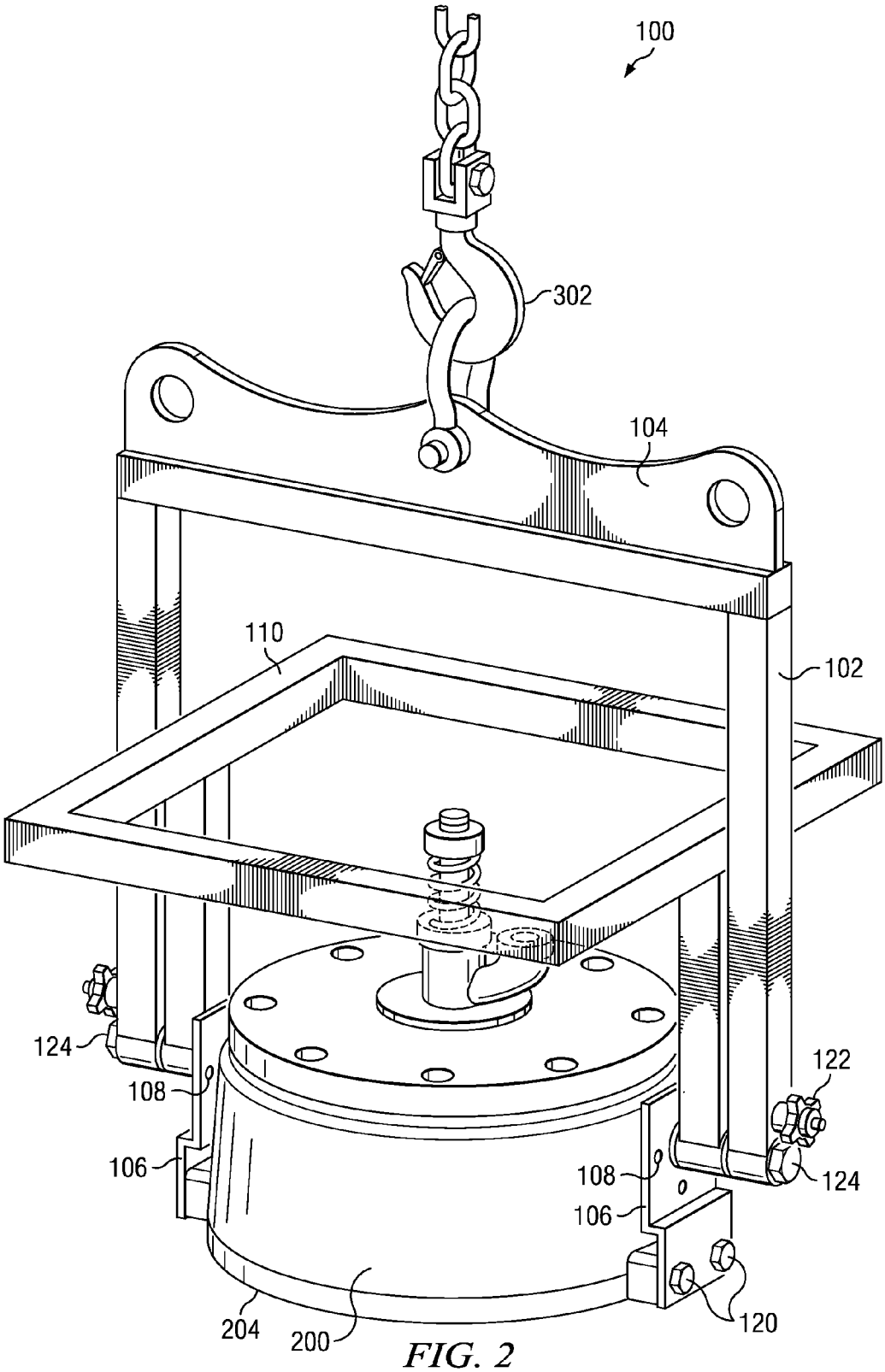
FIG. 2 is an image showing selected elements of an embodiment of a lift device.

Turning now to FIG. 2, an image showing selected elements of an embodiment of novel lift device 100 is depicted. Lift device 100 is shown with removed cylinder head 200 being supported by lift hook 302 coupled to flange 104 of lift frame 102. Visible in FIG. 2 are both instances of head connector 106 (including respective locking holes 108), locking pin 122, and pivot pin 124, on respective sides of cylinder head 200. Lift device 100 is attached to cylinder 200 via one instance of head connector 106 and two mounting bolts 120 on both sides of cylinder head 200. In various embodiments (not shown), a different number and arrangement of mounting bolts 120 may be implemented. It is noted that, in the configuration shown, stand 110 forms a flat surface that is roughly parallel with seal surface 204, of which an edge is visible in FIG. 2.

Figure 3:
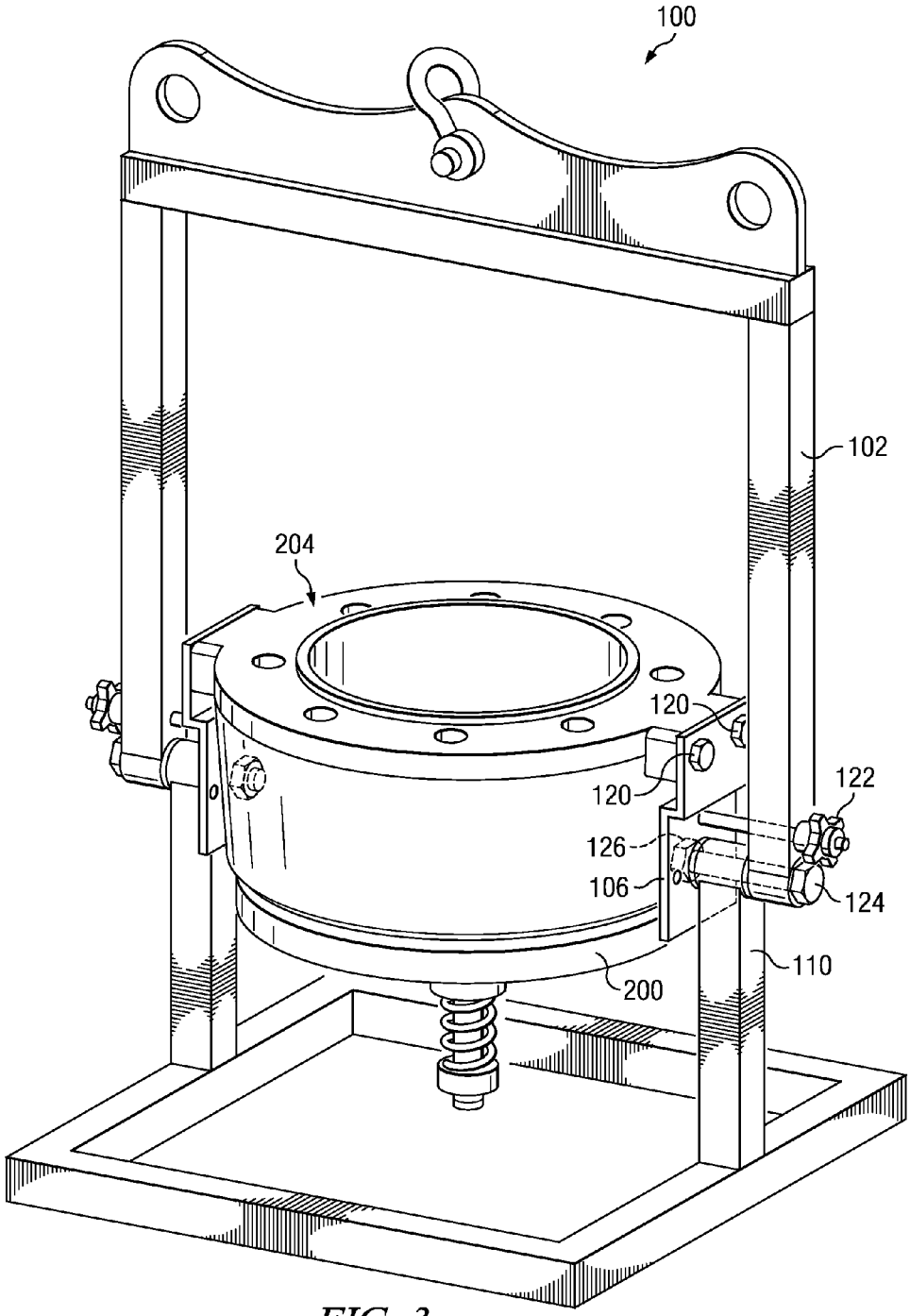
FIG. 3 is an image showing selected elements of an embodiment of a lift device.

Advancing now to FIG. 3, an image showing selected elements of an embodiment of novel lift device 100 is depicted. Lift device 100 is shown with cylinder head 200 being made accessible as a work piece for service operations, for example, on seal surface 204. Lift device 100 is shown in FIG. 3 in a free-standing configuration, with stand 110 serving as a base for supporting lift frame 102 and cylinder head 200. It is noted that, in FIG. 3, lift hook 302 (see FIGS. 1, 2) is no longer attached to lift device 100. Visible in FIG. 3 is pivot nut 126 for bolting together lift frame 102, stand 110, and head connector 106 using pivot pin 124. Locking pin 122, shown protruding through head connector 106, is used to fix stand 110 in an upright configuration, as shown. It is noted that no change in the attachment of cylinder head 200 to head connector 106 via mounting bolts 120 has taken place among the configurations of lift device 100 shown in FIGS. 1, 2 and 3.

It is further noted that, in various embodiments, stand 110 may be configured in different shapes and configurations, which may depend on a particular work piece for which lift device 100 is intended. As shown in the drawings, lift device 100 may be constructed using substantially straight members having a rectangular cross-section, for example, such as a square cross-section. In particular embodiments, the members with which lift device 100 is constructed may be hollow members of a suitable material, such as steel. The members may also be solid, when desired. The members with which lift device 100 is constructed may be round in cross-section and/or in shape (not shown in the drawings). The members with which lift device 100 is constructed may be selected by material and/or geometric form for a desired environment or operational condition. Certain portions of lift device 100 may be coated and/or painted for desired operational purposes and still perform the methods and operations described herein.

To the maximum extent allowed by law, the scope of the present disclosure is to be determined by the broadest permissible interpretation of the following claims and their equivalents, and shall not be restricted or limited to the specific embodiments described in the foregoing detailed description.

What is claimed is:

1. A lift device for supporting a work piece, comprising:

a lift frame, including a lifting point for attaching a lift hook and including two axially aligned lift bushings installed at end portions of the lift frame;

a stand frame including two axially aligned stand bushings installed at end portions of the stand frame and including a base portion that provides a support for the work piece and the lift frame;

two pivot pins that respectively couple each of the two lift bushings with each of the two stand bushings, wherein the pivot pins enable the stand frame to rotate 360° about the lift frame about an axis on which the lift bushings and the stand bushings are aligned; and two connecting plates that respectively mount to each pivot pin and are coupled to the stand frame, wherein each connecting plate includes an attachment point configured for connecting to the work piece and further includes at least one locking hole for arresting rotation of the stand frame.

2. The lift device of claim 1, further comprising:

a locking pin penetrating the lift frame, the stand frame, and one of the two connecting plates.

3. The lift device of claim 2, comprising a second locking pin.

4. The lift device of claim 2, wherein the locking pin is removable.

5. The lift device of claim 1, wherein the lift frame and the stand frame are comprised of hollow rectangular cross-section steel members.

6. The lift device of claim 1, wherein the lift frame and the stand frame are comprised of substantially straight members.

7. The lift device of claim 1, wherein the two connecting plates each include a plurality of locking holes corresponding to angular positions of the stand frame with respect to the lift frame.

8. The lift device of claim 1, further comprising:

a lifting plate attached to the lift frame and that includes the lifting point.

9. The lift device of claim 8, wherein the lifting point is a hole in the lifting plate.

10. The lift device of claim 9, wherein the lifting plate includes a plurality of lifting points.

11. The lift device of claim 8, wherein the lifting point causes the lift device to tilt, when lifted at the lifting point, at a first angle roughly corresponding to a second angle given by an operational orientation of the work piece.

12. The lift device of claim 1, wherein the lift frame is substantially U-shaped.

13. The lift device of claim 1, wherein the base portion stabilizes the lift frame and the work piece when the lift device rests on a surface.

14. The lift device of claim 1, wherein the work piece is a power cylinder head of a gas engine compressor.

15. A lift device for supporting a work piece, comprising:

a substantially U-shaped lift frame, including a lifting member affixed to two outer side members of the lift frame and including two axially aligned lift bushings installed at respective end portions of the outer side members;

a stand frame including a base portion affixed to two inner side members and including two axially aligned stand bushings installed at respective end portions of the inner side members, wherein the base portion stabilizes the lift frame and the work piece when the lift device rests on a surface;

two pivot pins that respectively couple each of the two lift bushings with each of the two stand bushings, wherein the stand frame rotates 360° about the two pivot pins within the lift frame, and wherein the two pivot pins define an axis on which the two outer side members and the two inner side members are aligned;

two connecting plates that respectively mount to the inner side members, wherein each connecting plate includes an attachment point for the work piece and at least one locking hole for arresting rotation of the stand frame with respect to the lift frame; and a locking pin penetrating an outer side member, an inner side member, and one of the two connecting plates.

16. The lift device of claim 15, wherein the lifting member includes a lifting plate with a lifting point.

17. The lift device of claim 16, wherein the lifting point is a hole in the lifting plate.

18. The lift device of claim 17, wherein the lifting point causes the lift device to tilt, when lifted at the lifting point, at a first angle roughly corresponding to a second angle given by an operational orientation of the work piece.

19. The lift device of claim 15, comprising:

a second locking pin penetrating another outer side member, another inner side member, and another one of the two connecting plates.

20. The lift device of claim 15, wherein each of the two connecting plates include a plurality of locking holes for mating with a locking pin and corresponding to angular positions of the stand frame with respect to the lift frame.

21. A method of supporting a work piece of a large engine, comprising:

suspending a lift device over the work piece, wherein the lift device comprises:

a substantially U-shaped lift frame, including a lifting point and including two axially aligned lift bushings respectively installed at end portions of the lift frame;

a stand frame including two axially aligned stand bushings respectively installed at end portions of the stand frame and including a base portion that provides a support for the work piece and the lift frame;

two pivot pins that respectively couple each of the two lift bushings with each of the two stand bushings, wherein the pivot pins enable the stand frame to rotate 360° with respect to the lift frame about at an axis on which the lift bushings and the stand bushings are aligned;

two connecting plates that are mounted to the stand frame, wherein each connecting plate includes an attachment point for the work piece and at least one locking hole for arresting rotation of the stand frame; and wherein the lift frame, the stand frame, and one of the two connecting plates are configured to receive a locking pin, and further wherein the locking pin penetrates a locking hole of the one of the two connecting plates;

following removal of the work piece from the large engine and while the lift device and the work piece are suspended:

removing the locking pin and rotating the stand frame with respect to the lift frame, wherein the base portion is extended from the lift frame; and fastening the locking pin to arrest rotation of the stand frame; and resting the lift frame and the work piece on a surface supported by the base portion.

22. The method of claim 21, further comprising:

lifting, using the lift frame, the lift device and the work piece when supported by the base portion while at rest on a surface;

while the lift device and the work piece are suspended:

removing the locking pin and rotating the stand frame with respect to the lift frame, wherein the base portion is retracted within the lift frame; and fastening the locking pin to arrest rotation of the stand frame; and using the lift device to position the work piece on the large engine.

* * * * *